US005890242A

United States Patent [19]

Minter

[11] Patent Number: 5,890,242

[45] Date of Patent: Apr. 6, 1999

[54] ELECTRONIC POTTY TRAINER WITH AUDIBLE REWARDING SYSTEM AND VISUALLY AMUSING TARGET

[76] Inventor: Ericka Minter, 1729 Pine Lane, Magnolia, Tex. 77355

[21] Appl. No.: 967,430

[22] Filed: Nov. 10, 1997

[51] Int. Cl.[6] ..... A47K 17/00

[52] U.S. Cl. ..... 4/661; 4/902

[58] Field of Search ..... 4/661, 902

[56] References Cited

U.S. PATENT DOCUMENTS

| | | | |
|---|---|---|---|
| 2,075,308 | 3/1937 | Simonsen | 4/902 X |
| 2,361,677 | 10/1944 | Bramhall | 4/902 X |
| 2,699,139 | 1/1955 | Mackey | 4/902 X |
| 2,766,716 | 10/1956 | Mackey | 4/902 X |
| 5,031,253 | 7/1991 | Brendlinger | 4/300.3 |
| 5,117,512 | 6/1992 | Bressler | 4/300.3 |
| 5,117,515 | 6/1992 | White, Jr. et al. | 4/661 |
| 5,343,577 | 9/1994 | Petrovich | 4/661 |

*Primary Examiner*—Charles E . Phillips
*Attorney, Agent, or Firm*—Joseph N. Breaux

[57] ABSTRACT

An electronic potty training apparatus which visually and audibly amuses a child. The electronic potty training apparatus comprises a support frame removably attachable to a toilet, an audible rewarding system for audibly rewarding and amusing a child, and a rotatable target wherein the target provides visual amusement, an instructional focal point and a triggering mechanism for triggering the audible rewarding system.

3 Claims, 2 Drawing Sheets

ELECTRONIC POTTY TRAINER WITH AUDIBLE REWARDING SYSTEM AND VISUALLY AMUSING TARGET

TECHNICAL FIELD

The present invention relates to potty training apparatuses and, more particularly, to an electronic potty training apparatus with an audible rewarding system activated when a child hits with a urine stream a rotatable target for making potty training fun and exciting for the child wherein such rotatable target provides visual amusement for attracting the child's attention thereto.

BACKGROUND OF THE INVENTION

Potty training children can be quite difficult especially when teaching a male child to urinate. The parent's biggest challenge is to persuade their child to use the toilet when they need to potty. The next biggest challenge is to teach the child, particularly boys, to sanitarily use the toilet. Therefore, a potty training apparatus should merge amusement and fun with instructional value into one simple to use device.

Several devices have been patented which are aimed at potty training.

U.S. Pat. No. 5,343,577, by Petrovich, entitled "COMMODE FLOAT TOY TRAINING DEVICE" discloses a toy float made of water soluble material having a plurality of rows of water soluble rods having various colorations to maintain the interest and focus of the child.

U.S. Pat. No. 5,117,515, by White, Jr. et al., entitled "TOILET TRAINING DEVICE AND METHOD OF USE" teaches the use of a thin paper stock element adapted to float in a planar configuration upon the water surface which has indicia printed on both sides thereof. Such indicia represent a target or other geometric shape normally familiar to children to thereby attract the attention of the child.

While each of the above potty training apparatuses functions as desired, none of them have an audible rewarding system activated when a child hits with a urine stream a rotatable target for enhancing the amusement of the child when learning to use the toilet.

SUMMARY OF THE INVENTION

The preferred embodiment of the electronic potty training apparatus of the present invention solves the aforementioned problems in a straight forward and simple manner. What is provided is an electronic potty training apparatus with an audible rewarding system activated when a child hits with a urine stream a rotatable target for making potty training fun and exciting for the child wherein such rotatable target provides visual amusement for attracting the child's attention thereto.

The electronic potty training apparatus comprises:

(a) a support frame removably attachable to a toilet;

(b) an audible rewarding system coupled to said support frame for audibly rewarding and amusing a child; and, (c) a rotatable target rotatably coupled to said support frame wherein said target provides visual amusement, an instructional focal point and a triggering mechanism for triggering said audible rewarding system.

In view of the above, an object of the present invention is to provide an electronic potty training apparatus which visually and audibly amuses children thereby optimally merging amusement and fun with instructional value into one simple to use potty training apparatus.

Another object of the present invention is to provide an electronic potty training apparatus which uses visual amusement to attract the attention of the child to the desired target and uses audible voices and/or other sounds to reward, as well as, amuse the child for making the target.

A further object of the present invention is to provide an electronic potty training apparatus which is easily attached and detached from the rim of the toilet seat.

It is a still further object of the present invention to provide an electronic potty training apparatus which is easily cleaned between bathroom uses.

It is a still further object of the present invention to provide an electronic potty training apparatus which has a rotatable target having coupled thereto a triggering means wherein the rotatable target serves the triple function of 1) an instructional focal point to instruct a child to direct a urine stream into the toilet; 2) a visually amusing means for attracting the attention of the child; and, 3) a triggering mechanism for activating the audible rewarding system.

It is a still further object of the present invention to provide an electronic potty training apparatus which is simple to use and effective.

It is a still further object of the present invention to provide an electronic potty training apparatus which is simple and inexpensive to manufacture.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
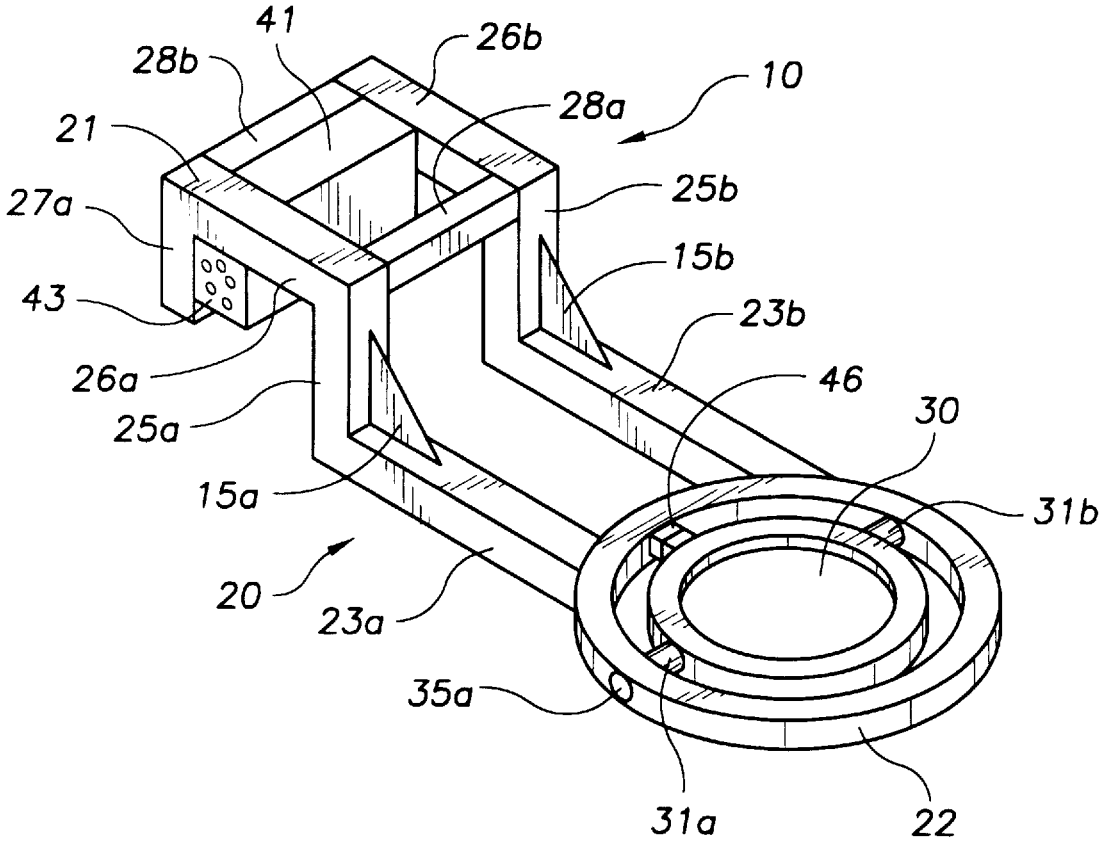
FIG. 1 illustrates a perspective view of the preferred embodiment of the electronic potty training apparatus of the present invention.
Figure 2:
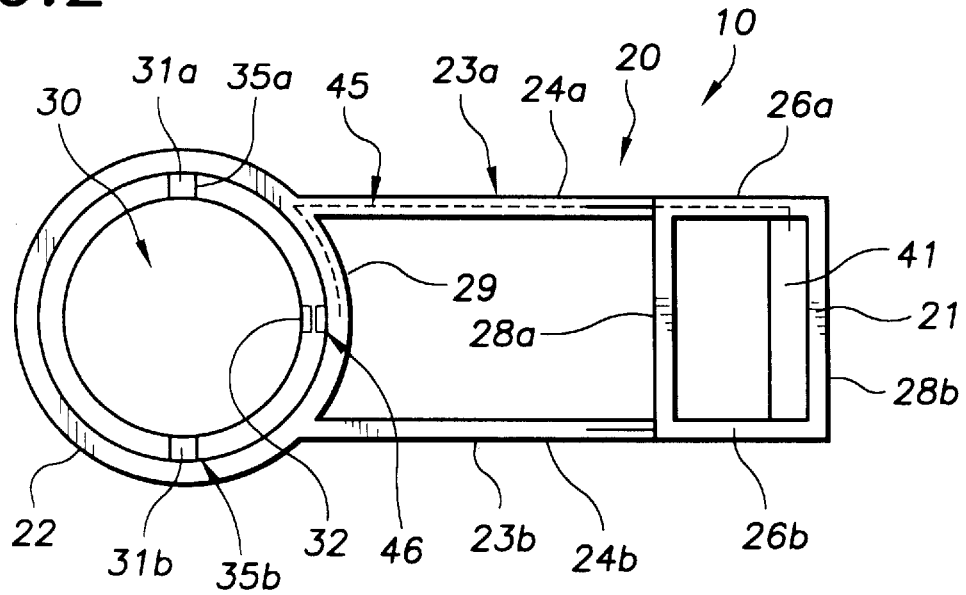
FIG. 2 illustrates a top view of the preferred embodiment of the electronic potty training apparatus of FIG. 1.
Figure 3:
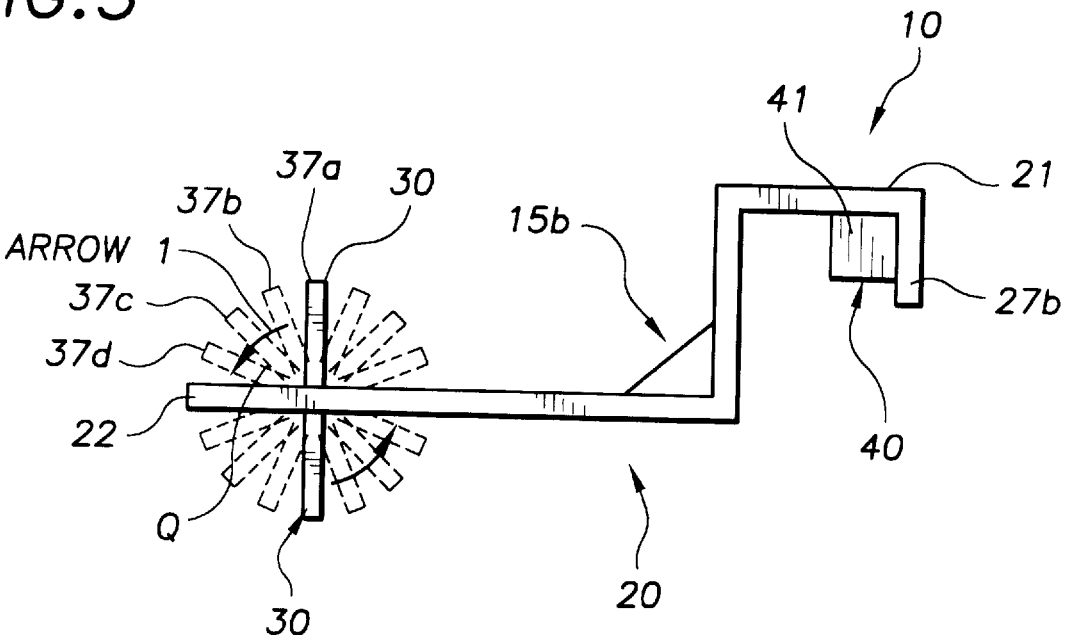
FIG. 3 illustrates a side view of the preferred embodiment of the electronic potty training apparatus of FIG. 1 wherein the rotatable target is shown in one of a plurality or target positions; and, FIG. 4 illustrates the interior compartment and electronic circuitry of the audible rewarding system.

Referring now to the drawings, and in particular FIGS. 1–3, the electronic potty training apparatus of the present invention is designated generally by hoe numeral 10. Electronic potty training apparatus 10 is comprised of support frame 20, rotatable target 30, and audible rewarding system 40.

Rotatable target 30 is a disc-shaped member rotatably coupled in the interior of target support member 22 of support frame 20. Nevertheless, rotatable target 30 may have any geometrical shape, as desired. The rotatable feature of rotatable target 30 serves to amuse the child. Furthermore, for added amusement of the child, rotatable target 30 may further comprise indicia, such as a cartoon character, or other geometric shape to attract the attention of the child to rotatable target 30 in the toilet bowl.

Rotatable target 30 comprises first and second pivot rod members 31*a* and 31*b* wherein first and second pivot rods 31*a* and 31*b* are spaced 180° from each other. Rotatable target 30 further comprises triggering means 32 recesses in the outer perimeter of the disc-shaped member wherein triggering means 32 is positioned 90° from first and second pivot rod members 31*a* and 31*b*, respectively.

As can be readily seen, rotatable target 30 having coupled thereto triggering means 32 serves the triple function of 1) an instructional focal point to instruct a child to direct a urine stream into the toilet; 2) a visually amusing means for attracting the attention of the child; and, 3) a triggering mechanism for activating audible rewarding system 40.

Support frame 20 comprises clipping means 21, target support member 22, and first and second extending legs 23*a* and 23*b*. First and second extending leg 23*a* and 23*b* comprises first and second horizontal long frame members 24*a* and 24*b* which serve to extend target support member 22 substantially into the center of the toilet bowl (not shown). Thereby the child has an unobstructed view of rotatable target 30 when standing in the front of the toilet (not shown). Clipping means 21 comprises first and second vertical long frame members 25*a* and 25*b*, first and second horizontal short frame members 26*a* and 26*b*, first and second vertical short frame members 27*a* and 27*b*, and first and second bar members 28*a* and 28*b*. First and second bar members 28*a* and 28*b* serve to rigidly separate first and second extending legs 23*a* and 23*b* and the frame members of clipping means 21.

Support frame 20 couples together clipping means 21, target support member 22, and first and second extending legs 23*a* and 23*b* in the manner as described below. One distal end of first and second horizontal long frame members 24*a* and 24*b* have perpendicularly coupled thereto one distal end of first and second vertical long frame members 25*a* and 25*b*, respectively. The other distal end of first second vertical long frame members 25*a* and 25*b* have coupled thereto perpendicularly one distal end of first and second horizontal short frame members 26*a* and 26*b*, respectively. The other distal end of first and second horizontal short frame members 26*a* and 26*b* have coupled thereto one distal end of first and second vertical short frame members 27*a* and 27*b*, respectively. The interior side surface of the junctures defined by first horizontal short frame member 26*a* as perpendicularly coupled to first vertical long frame member 25*a* and first vertical short frame member 27*a*, respectively, has coupled thereto one distal end of first and second bar members 28*a* and 28*b*, respectively. Likewise, the interior side surface of the junctures defined by second horizontal short frame member 26*b* as perpendicularly coupled to second vertical long frame member 25*b* and second vertical short frame member 27*b*, respectively, has coupled thereto the other distal end of first and second bar members 28*a* and 28*b*, respectively.

The other distal end of first and second long horizontal frame members 24*a* and 24*b* have coupled thereto target support member 22. Target support member 22 is ring shaped with an inner circumference slightly larger than the outer circumference of rotatable target member 30. Arc member 29 has embedded in the center thereof activation means 46 of audible rewarding system 40. Arc member 29 is defined by the arc formed by the intersection of first and second long horizontal frame members 24*a* and 24*b* with target support member 22. Target support member 22 has formed therein first aperture 35*a* which is 90° from the center of arc member 29 in a first direction and second aperture 35*b* which is 90° from the center of arc member 29 in a second direction. First aperture 35*a* and second aperture 35*b* have rotatably coupled therein first and second pivot rod members 31*a* and 31*b*, respectively, of rotatable target 30. Thereby rotatable target 30 is capable of rotating 360° within target support member 22.

In the preferred embodiment, first and second horizontal long frame members 24*a* and 24*b*, first and second vertical long frame members 25*a* and 25*b*, first and second horizontal short frame members 26*a* and 26*b*, first and second vertical short frame members 27*a* and 27*b*, first and second bar members 28*a* and 28*b*, and target support member 22 are hollow. Thereby electronic potty training apparatus 10 is lightweight. The length of first and second vertical long frame members 25*a* and 25*b* serves to position target support member 22 a predetermined depth in the toilet bowl. The length of first and second vertical long frame members 25*a* and 25*b* should be chosen such that the rotation of rotatable target 30 is not hindered or obstructed by the water in the toilet bowl. The length of first and second horizontal short frame members 26*a* and 26*b* should be chosen such that clipping means 21 can be easily clipped to the rim of a variety of toilets.

Support frame 20 further comprises first and second brace members 15*a* and 15*b*. First brace member 15*a* is coupled to the top surface of the corner defined by the juncture of first horizontal long frame member 24*a* and first vertical long frame member 25*a*. Second brace member 15*b* is coupled to the top surface of the corner defined by the juncture of second horizontal long frame member 24*b* and second vertical long frame member 25*b*.

Figure 4:
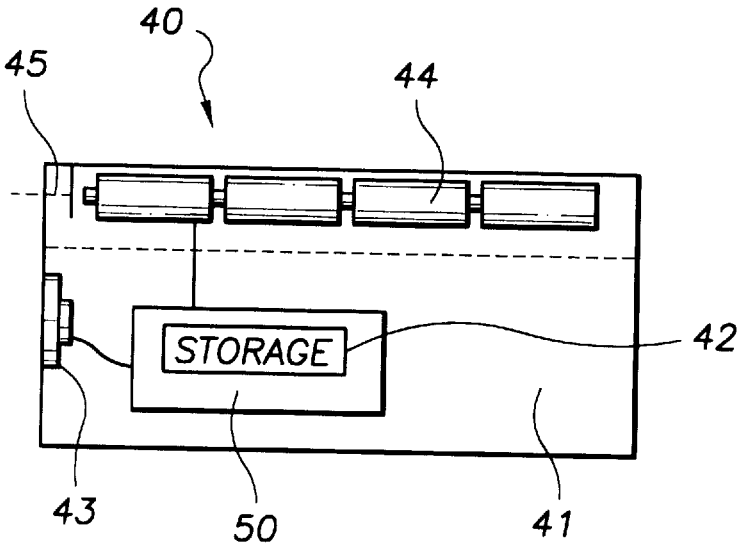

Referring now to FIG. 4, audible rewarding system 40 comprises housing means 41, electronic circuitry 50, power source 44, wiring means 45 and activation means 46. Electronic circuitry 50 comprises storage means 42 and audio output means 43.

Storage means 42 may be any such means capable of storing prerecorded voice and/or other audible sound amusing and rewarding to a child when the child hits rotatable target 30 with the urine stream. For example, storage means 42 may be an EEPROM capable of storing direct analog data into the semiconductors memory. Using direct analog data storage eliminates the need for an analog-to-digital converter and a digital-to-analog converter. Nevertheless, alternatively, storage means 42 may be a digital storage device henceforth A/D and/or D/A converters may be required. Audio output means 43 is a speaker, such as an 8-ohm speaker or a 16-ohm speaker.

Power source 44 comprises a standard battery assembly capable of delivering power to the electronic circuitry 50. In the preferred embodiment, power source 44 comprises four AA batteries. Nevertheless, any battery assembly capable of delivering power to adequately power such electronic circuitry 50 may be substituted.

Activation means 46 serves to allow power from power source 44 to be delivered to electronic circuitry 50 when triggered by triggering means 32 wherein, as power is delivered to electronic circuitry 50, storage means 42 transfers the stored voice and/or other audibly amusing and rewarding sound to audio output means 43. In the preferred embodiment, activation means 46 comprises a magnetic reed switch mechanism and triggering means 32 comprises a magnetic means. Activation means 46 is coupled to electronic circuitry 50 and power source 44 via wiring means 45 wherein wiring means 45 is journalled through the hollow frame members of support frame 20.

In operation, activation means 46 activates electronic circuitry 50 when said magnetic means (triggering means 32) coupled to rotatable target 30 comes in relative close proximity with the reed switch mechanism. As said magnetic means comes in close proximity with the reed switch mechanism, activation means 46 activates electronic circuitry 50.

Alternatively, in lieu of a magnetic reed switch assembly, activation means 46 may be a lever-actuated switch wherein, as rotatable target 30 rotated, a force of pressure exerted on the lever member from rotatable target 30 would urge the lever member inwardly to activate the switch.

Housing means 41 comprises a rectangularly-shaped housing for storing therein electronic circuitry 50. In the preferred embodiment, one of the side walls of housing means 41 has coupled thereto audio output means 43. In the preferred embodiment, housing means 41 is coupled to clipping means 21 such that housing means 41 is positioned outside of the toilet bowl.

In operation, clipping means 21 is coupled to the front of the toilet rim of the toilet. Rotatable target 30 is rotated from is off position to one of a plurality of target positions, as best seen in FIG. 3, wherein the plurality of target positions comprises vertical position 37*a*, angled positions 37*b*, 37*c* and 37*d* and all other positions within the 90° angle of quadrant Q. The off position corresponds to any such position which serves to maintain activation means 46 inactivated. In the preferred embodiment, when electronic potty training apparatus 10 is be stored between bathroom uses, triggering means 32 should be 180° from activation means 46 to thereby extend the life of power source 44.

After rotatable target 30 is rotated to is one of the plurality of target positions, the child is coached to hit rotatable target 30 with the child's urine stream. The force of pressure of the urine stream causes rotatable target 30 to rotate in the direction of ARROW 1. As rotatable target 30 rotates in the direction of ARROW 1, triggering means 32 comes in close proximity and/or becomes aligned with activation means 46. As triggering means 32 comes in close proximity and/or aligns with activation means 46, activation means 46 activates electronic circuitry 50. The activated and powered electronic circuitry 50 generates audibly rewarding and amusing sound via audio output means 43.

After the child has finished urinating, electronic potty training apparatus 10 is removed from the toilet and cleaned with soap and water or any other cleaning fluid.

In the preferred embodiment, electronic potty training apparatus 10 is generally made of plastic or any other material which is lightweight and easily cleaned.

It can be seen from the preceding description that an electronic potty training apparatus 10 which visually and audibly amuses children for optimally merging amusement and fun with instructional value into one simple to use potty training apparatus has been provided.

It is noted that the embodiment of the electronic potty training apparatus described herein in detail, for exemplary purposes, is of course subject to many different variations in structure, design, application and methodology. Because many varying and different embodiments may be mace within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An electronic potty training apparatus comprising:

a support frame removably attachable to a toilet;

an audible rewarding system coupled to said support frame for audibly rewarding and amusing a child; and, a rotatable target rotatably coupled to said support frame wherein said target provides visual amusement, an instructional focal point and a triggering mechanism for triggering said audible rewarding system;

said support frame comprising:

clipping means for clipping said support frame to a toilet bowl rim of a toilet;

a target support member for rotatably supporting said rotatable target; and, first and second extending legs for extending said target support member into the middle of a toilet bowl of said toilet;

said audible rewarding system comprising activation means, coupled to said target support member, for activating said audible rewarding system when triggered by said rotatable target;

said rotatable target comprising a triggering means recessed in an outer perimeter thereof wherein, as said rotatable target rotates via a force of pressure from a urine stream, said triggering means comes in close proximity or aligns with said activating means for triggering said activating means and in response thereto said audible rewarding system audibly rewards and amuses said child.

2. An electronic potty training apparatus comprising:

a support frame removably attachable to a toilet;

an audible rewarding system coupled to said support frame for audibly rewarding and amusing a child; and, a rotatable target rotatably coupled to said support frame wherein said target provides visual amusement, an instructional focal point and a triggering mechanism for triggering said audible rewarding system;

said support frame comprising:

clipping means for clipping said support frame to a toilet bowl rim of a toilet;

a target support member for rotatably supporting said rotatable target; and, first and second extending legs for extending said target support member into the middle of a toilet bowl of said toilet;

said clipping means comprising:

first and second vertical long frame members;

first and second horizontal short frame members having one distal end perpendicularly coupled to one distal end of said first and second vertical long frame members, respectively;

first and second vertical short frame members having one distal end perpendicularly coupled to the other distal end of said first and second horizontal short frame members, respectively; and first and second bar members wherein one distal end of said first and second bar members is perpendicularly coupled to an interior side surface of junctures defined by said first horizontal short frame member as perpendicularly coupled to said first vertical long frame member and said first vertical short frame member, respectively, and the other distal end of said first and second bar members is perpendicularly coupled to an interior side surface of junctures defined by said second horizontal short frame member as perpendicularly coupled to said second vertical long frame member and said second vertical short frame member, respectively;

wherein said first and second extending legs comprise first and second horizontal long frame members wherein one distal end of said first and second horizontal long frame members have perpendicularly coupled thereto the other distal end of said first and second vertical long frame members, respectively; and, wherein said target support member is ring shaped and has coupled thereto the other distal end of said first and second long horizontal frame members.

3. An electronic potty training apparatus comprising:

a support frame removably attachable to a toilet;

an audible rewarding system coupled to said support frame for audibly rewarding and amusing a child; and, a rotatable target rotatably coupled to said support frame wherein said target provides visual amusement, an instructional focal point and a triggering mechanism for triggering said audible rewarding system;

said support frame comprising:

clipping means for clipping said support frame to a toilet bowl rim of a toilet;

a target support member for rotatably supporting said rotatable target; and, first and second extending legs for extending said target support member into the middle of a toilet bowl of said toilet;

said clipping means having coupled thereto said audible rewarding system wherein said audible rewarding system is positioned outside said toilet bowl.

* * * * *